United States Patent [19]

Getsch

[11] 3,974,626

[45] Aug. 17, 1976

[54] SLIDE CASSETTE PACKER

[75] Inventor: Edward W. Getsch, Minneapolis, Minn.

[73] Assignee: Pako Corporation, Minneapolis, Minn.

[22] Filed: Sept. 9, 1975

[21] Appl. No.: 611,629

[52] U.S. Cl. ..... 53/244; 214/7; 271/216

[51] Int. Cl.[2] ..... B65B 5/10; B65B 35/56

[58] Field of Search ..... 53/244, 159, 242, 243, 53/247, 147; 198/35; 214/7; 271/213, 216

[56] References Cited

UNITED STATES PATENTS

| | | | |
|---|---|---|---|
| 1,581,583 | 4/1926 | Low | 271/216 X |
| 2,238,010 | 4/1941 | Breman | 271/216 |
| 2,747,352 | 5/1956 | Whitecar | 53/159 |
| 3,842,719 | 10/1974 | Fernandez-Rana et al. | 214/7 X |
| 3,874,522 | 4/1975 | Rana | 214/7 |

*Primary Examiner*—Travis S. McGehee
*Assistant Examiner*—Horace M. Culver
*Attorney, Agent, or Firm*—John W. Adams

[57] ABSTRACT

A mechanism for collecting and arranging into a horizontal stack a large quantity of photographic slides being delivered from a photographic slide mounting machine, which includes a transfer and packing belt positioned to receive the mounted slides in overlapped relation and an elongated carrier cassette which is open on the bottom and at one end and is mounted over the upper run of said belt to enclose the same and provided with a generally inclined stacking element at the end of said cassette which is remotely disposed from said delivery mechanism of the mounting machine, the leading edge of said stacking element positioned in closely spaced relation above the upper run to receive and progressively raise into upstanding horizontally stacked relation the mounted slides being transferred by said belt. This invention also embodies the method for arranging said slides into a closely packed horizontal stack within a carrier cassette adapted for transportation and/or storage of the mounted slides.

4 Claims, 8 Drawing Figures

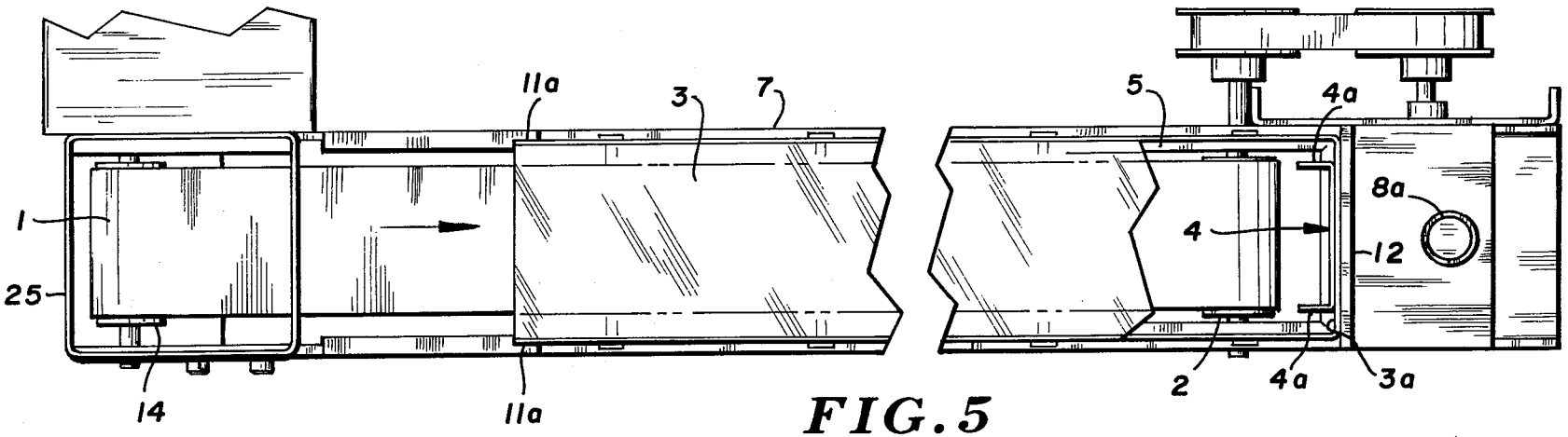
FIG. 5
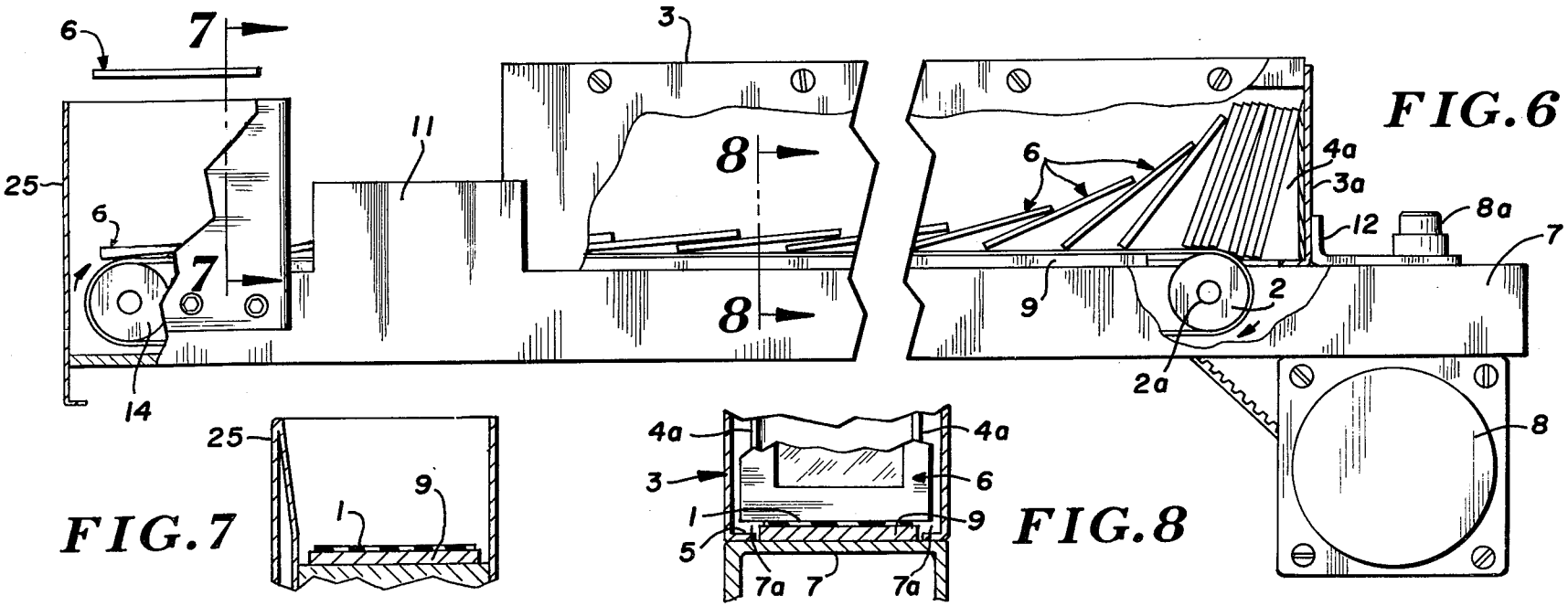
FIG. 6
FIG. 8
FIG. 7

SLIDE CASSETTE PACKER

BACKGROUND OF THE INVENTION

Most of the photographic slide mounting machines in use today utilize a movable conveyor belt to transport mounted slides from the mounting machine to a collecting station where they are manually packed by an operator. The collecting station may include a bin or series of bins into which the mounted slides fall from the end of the conveyor belt, and which do not hold more than 50 to 100 slides. A typical slide mounter has a magazine in which a supply of 500 mounts can be provided so that it is a great convenience to provide a carrier which has a similar capacity so that the mounter can be operated continuously for each filling of the magazine.

This invention provides an inexpensive and compact mechanism having sufficient capacity to collect and arrange a great number of upstanding slides into a horizontal stack confined within a carrier cassette. Said cassette fits over and encloses a packing conveyor belt, which receives the mounted slides from the slide mounting and delivering machine and packs the same into the cassette thus eliminating the manual packing operation and the need for additional space at the end of the belt, necessary in prior art collecting devices. The carrier cassette requires replacing only when the slide mount magazine is filled and provides easy transportation and storage for the slides packed in it.

Therefore, it is an object of this invention to provide a mechanism and method for automatically collecting and stacking in a carrier cassette, large quantities of slides being delivered from a slide mounting machine; and for confining said slides in said cassette for easy removal, transportation and storage.

More particularly, it is an object of this invention to provide an elongated slide carrier cassette which is positioned so as to enclose a conveyor belt which receives mounted slides from a slide mounting machine, said cassette collecting and packing the mounted slides received from said mounting machine and holding said slides in upstanding horizontally stacked relation along said belt, permitting the stacked slides to be easily removed from the belt for transportation and storage in said cassette.

These and other objects and advantages of this invention will be apparent from the following description made in connection with the accompanying drawing wherein like reference characters refer to similar parts throughout the several views, and in which:

FIG. 1 is a perspective view showing the slide cassette packer attached to a slide mounting and delivering machine;

FIG. 2. is a top plan view showing portions of the slide packing cassette and the slide mounting and delivering machine;

FIG. 5 is a top plan view of the carrier cassette and packing mechanism;

FIG. 6 is a front elevational view thereof with portions broken away;

FIG. 7 is a fragmental sectional view taken substantially along the line 7—7 of FIG. 6; and, FIG. 8 is a fragmental sectional view taken substantially along the line 8—8 of FIG. 6.

Figure 1:
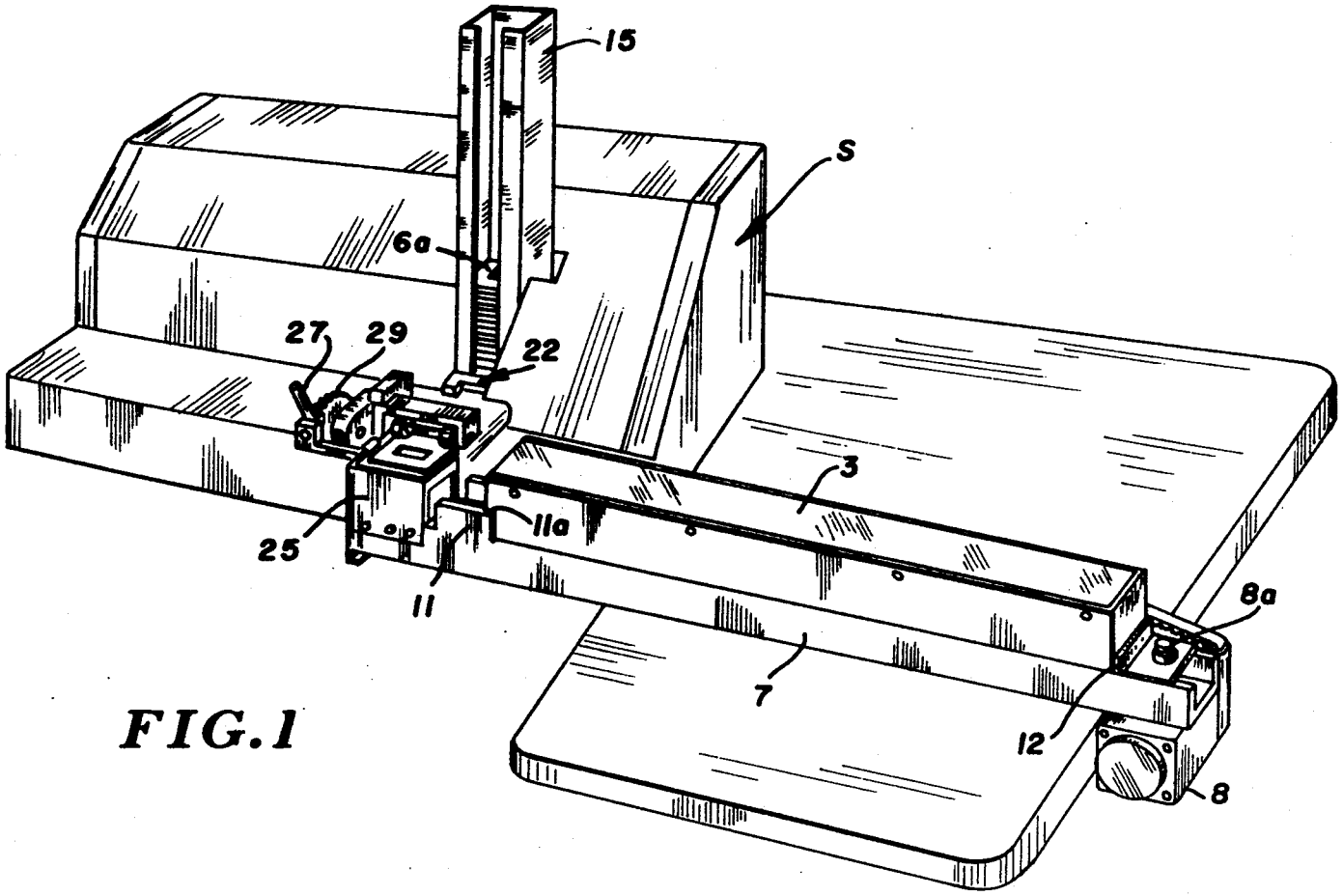

Referring now to the drawings, a flexible transfer and packing belt 1 is mounted about a drive roller 2 and idler roller 14 and is positioned to receive slides 6 delivered into a guiding chute 25 by the delivery mechanism of the mounting station 54 of slide mounting machine S as shown, such as the Pakon Slide Mounter manufactured by the Pako Corporation of Minneapolis, Minn. A drive shaft **2*a* is rotatably supported by suitable supports and connects drive roller 2 to suitable driving means such as an electric motor 8 which rotates said roller 2 and drives the belt 1 in the direction shown by the arrows in FIG. 6**.

A slide carrier cassette 3, comprising an elongated generally rectangular container constructed of a rigid material which in the form shown is open at the bottom and one end has elongated edges of said open bottom formed to provide flanges 5 spaced slightly further apart than the width of the belt 1 but substantially less than the width of the slides 6. An inclined stacking member 4 is provided at the closed end of cassette 3 and receives the mounted slides 6 from the upper run of the belt 1 when the cassette is positioned thereon.

The cassette 3 is supported and positioned on a rigid supporting frame 7 which has a raised central belt supporting platform 9 fixed thereto in underlying relation to said conveyor belt 1 and of substantially the same width as said belt. The frame 7 is somewhat wider than the platform 9 and a pair of longitudinal recesses **7*a* are formed along the sides of said raised platform 9. The flanges 5 are received in said recesses and the space between said flanges is substantially equal to the width of the raised platform 9 to provide lateral support for the cassette 3 throughout substantially its entire length. The ends of the cassette are positioned by positive stop elements such as the upstanding stabilizing plate members 11 provided with milled out recesses 11*a* which receive in positive abutted relation the ends of the cassette sides. An upstanding abutment plane 12 is fixed at the other end of the flange 7 and positively engages the remote end of the cassette to hold the same in the recesses 11*a***.

An inclined stacking member 4, which in the form shown is bifucated to form a pair of spaced apart inclined fingers **4*a*, is provided at the remote end of the cassette to receive the slides as they are transported by the belt 1 from the receiving end of the cassette. The inclined stacking member 4, in the form shown, is mounted on a closure plate 3*a* which forms a closure for the remote stacking end of the cassette 3. A suitable switch 8*a* is provided for energizing the conveyor drive motor 8. When the cassette 3 is in operative slide-receiving position with the flanges 5 supported on the frame 7 in the recesses 7*a*, the upper inside slide-engaging surfaces of said flanges 5 are disposed below the plane defined by the upper run of belt 1 on its supporting platform 9, as best shown in FIG. 8**.

The mounted slides are supplied directly from the delivery mechanism of the slide mounting machine S which has a slide frame supply magazine 15 attached to a base member 16. A support frame 17 has a pair of guide rails 18 and 19 fixed thereto. A fork mounting member 20 is slidably mounted upon said guides 18 and 19. A slide feeding fork 21 is attached to said member 20 in alignment with magazine base member 16, as shown. Said magazine 15 has a slide discharge opening **15*a* in front to allow each individual slide mounting frame (or slide mount) 6***a* to be fed into a mounting station 22 aligned with said opening 15*a*. A pair of fork receiving guide openings 15*b* are provided in the back of magazine 15 to allow said slide feeding fork 21 to be received therethrough. An actuating lever 23 is received within a connecting housing 20*a* to connect said lever to said member 20 in the manner shown. Said slide mounting station 22 holds the slide mounting frames 6*a* in a pair of opposed grooved track elements 24 and 26 during insertion of the slide transparency 6*b* into the mounting frame by a suitable mechanism (not shown).

In typical operation, the end of lever 23 received in housing 20*a*, is moved by suitable actuating means (not shown) towards magazine 15, thus causing said fork mounting member 20 to move along said guides 18 and 19 and drive slide fork 21 into engagement with the bottom slide mount 6*a* of the vertical stack in magazine 15. This pushes said bottom slide mount 6*a* into mounting position in station 22. Said lever 23 is then moved away from magazine 15, causing mounting member 20 and fork 21 to return to their original position. A slide transparency 6*b* is then inserted by the means (not shown) embodied in said Pakon Slide Mounter M into the slide mount 6*a*. Lever 23 then retracts fork 21 back behind the magazine 15 and thereafter moves the fork forwardly to drive the next mount 6*a* into station 22. This causes mounted slide 6 to be ejected from station 22 and discharged into slide chute 25 where it is deposited onto the receiving end of conveyor belt 1. The speed of belt 1 relative to the slide mounting and ejecting speed is such that the slides ejected from station 22 are positioned upon belt 1 in overlapped "shingle" relation.

The belt 1 transports the slides 6 to the remote stacking end of cassette 3, toward the inclined stacking fingers 4*a*. When the first slide 6 contacts the fingers 4, the movement of the belt 1 and the added friction of the following overlapped slides 6 causes the leading end of the slide contacting the fingers 4*a* to be forced up along the inclined edges of the fingers 4*a* until said first slide 6*a* is substantially vertical at the stacking end of said cassette 3. Since the slides 6 are overlapped, as shown, the upward movement of the first slide 6 causes all following slides 6 to be forced by the movement of belt 1 into substantially vertical upstanding position inside the cassette 3, thus forming a horizontal stack of upstanding slides 6 positioned along belt 1 and confined within cassette 3.

As previously stated, The distance between the flanges 5 is less then the width of slides 6, but greater than the width of the belt 1, so that a filled cassette 3 can easily be removed from around belt 1 but the slides 6 are restrained from falling out of the bottom of the cassette 3 by the flanges 5 and their contact with the adjacent stacked slides.

Figures 2, 3, 4:
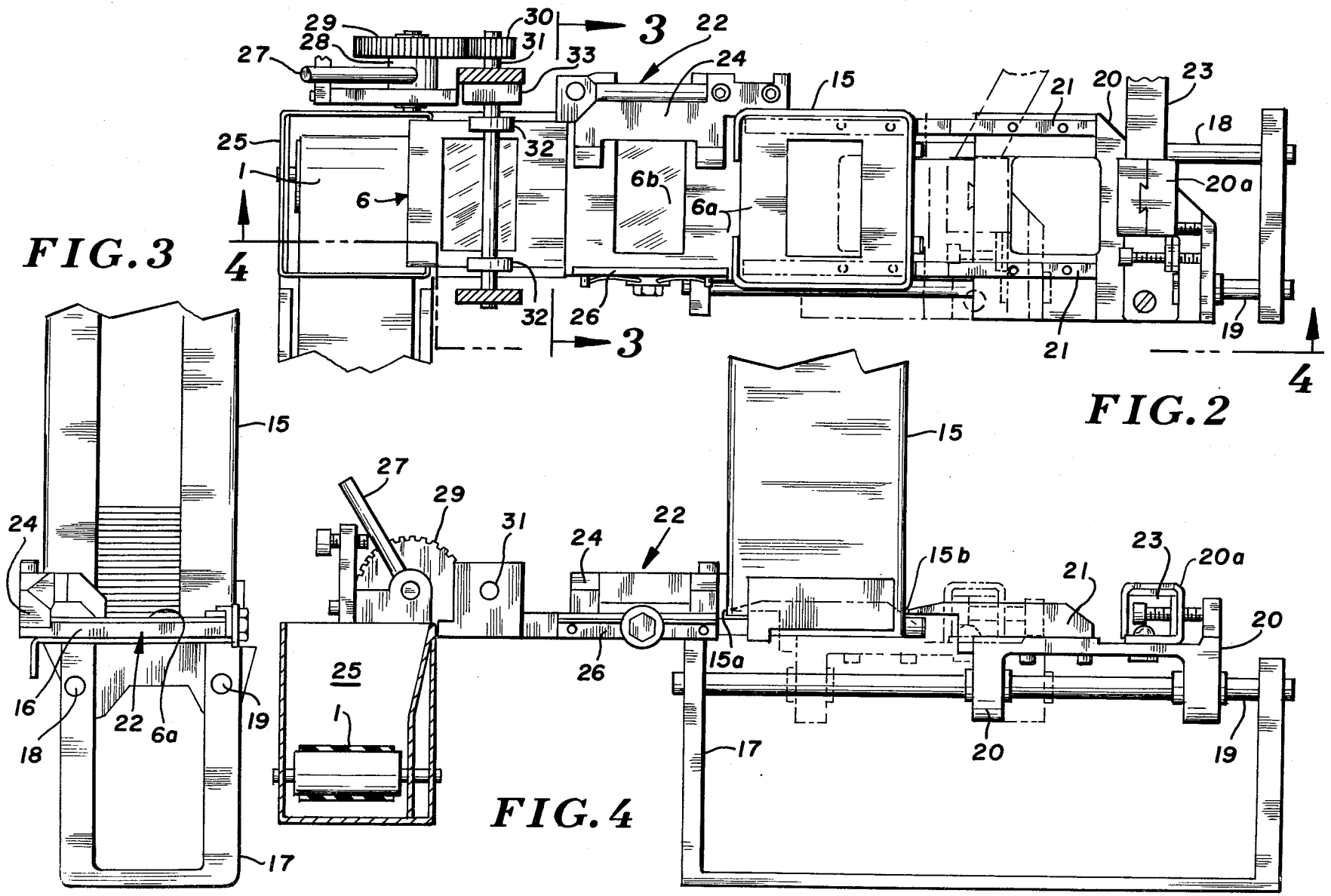
FIG. 3 is a transverse sectional view taken substantially along the line 3—3 of FIG. 2.
FIG. 4 is a view taken substantially along the line 4—4 of FIG. 2 showing certain parts in side elevation and certain parts in section.

A suitable last-slide feeding device is shown in FIG. 2, which is comprised of a manually operated handle 27 fixed to a shaft 28 which rotates a ring gear 29 which in turn meshes with a pinion 30 fixed to a shaft 31 which drives the rollers 32 through a one-way clutch 33. This permits manual ejection of the last slide from the mounting station into the delivery chute 25. When the last slide mount 6*a* contained in magazine 15 is driven by fork 21 into station 22, there is no remaining slide mount 6*a* to force the slide 6 out of station 22 so when handle 27 is moved towards magazine 15 of the rollers 26 drive the last mounted slide 6 into chute 25.

It will be seen that I have provided a mechanism for simply and compactly collecting and arranging a great number of mounted photographic slides (received from a slide mounting machine) into a horizontal stack along a transporting and stacking belt and for confining said stack within a container suitable for transporting and storing said stack.

It will, of course, be understood that various changes may be made in the form, details, arrangement and proportions of the parts without departing from the scope of this invention as set forth in the appended claims.

What is claimed is:

1. For use with a photographic slide mounting machine which includes a slide delivering mechanism for discharging the mounted slides from said machine; a slide packing mechanism, comprising a transporting and stacking conveyor having a receiving end and stacking end and constructed and arranged to successively receive at the receiving end the mounted slides from the delivery mechanism of the mounting machine in overlapped "shingled" relationship and transport said overlapped slides toward the stacking end thereof, an elongated carrier cassette removably mounted on said conveyor and having sides spaced apart a distance greater than the width of the slides to be packed, a pair of spaced apart inwardly extending flanges provided at the bottom of said cassette sides and disposed below the slides being transported, the space between said flanges being less than the width of the slides but greater than the width of said conveyor to receive and capture said slides within said cassette, an inclined stacking member at the stacking end of said cassette to shift the overlapped slides being transported by the conveyor up into substantially vertical position and from a horizontal stack of upstanding slides packed within said cassette, said inwardly extending flanges retaining said slides in said cassette to permit removal of the packed slides from said conveyor and said conveyor being constructed and arranged to slidably engage the stacked slides during the transporting and stacking of successive slides in the cassette.

2. The mechanism set forth in claim 1 and said conveyor comprising a flexible conveying belt narrower in width than the spacing between said flanges trained about a pair of pulleys and supported by a conveyor frame, said cassette being removably mounted on said frame, the upper run of said conveying belt being disposed above the flanges of said cassette where said cassette is so mounted.

3. The mechanism set forth in claim 2 and further comprising, a plurality of stop elements attached to said conveyor frame to longitudinally position said cassette on said conveyor frame and means to laterally position said cassette on said conveyor frame.

4. The mechanism set forth in claim 3 and said means to laterally position said cassette on said frame comprising a pair of longitudinally directed grooves in said conveyor frame and adjacent to said belt and adapted to receive the flanges of said cassette.

* * * * *